US005220962A

United States Patent [19]

Muller et al.

[11] Patent Number: 5,220,962

[45] Date of Patent: Jun. 22, 1993

[54] PUMP APPARATUS FOR PUMPING WELL FLUIDS FROM A WELLBORE HAVING LOW FORMATION PRESSURE

[75] Inventors: Laurent E. Muller, Houston; Steven L. Anyan, Sugar Land, both of Tex.

[73] Assignee: Schlumberger Technology Corporation, Houston, Tex.

[21] Appl. No.: 764,600

[22] Filed: Sep. 24, 1991

[51] Int. Cl.[5] ..... E21B 43/00

[52] U.S. Cl. ..... 166/369; 166/68; 166/73; 166/105; 166/305.1; 417/553

[58] Field of Search ..... 166/369, 73, 68, 105, 166/106, 117.7, 68.5, 107-111, 78, 305.1; 417/552, 553, 437, 415, 461

[56] References Cited

U.S. PATENT DOCUMENTS

| | | | |
|---|---|---|---|
| 529,804 | 11/1894 | Pickett | 417/415 |
| 1,868,098 | 7/1932 | Ekstromer | 417/415 X |
| 2,171,171 | 8/1939 | Brauer | 166/68 |
| 2,377,743 | 6/1945 | Arutunoff | 417/415 |
| 2,465,138 | 3/1949 | Van-Tuyl | 417/461 |
| 2,946,387 | 7/1960 | Hooker, Jr. | 166/105 |
| 3,177,943 | 4/1965 | McCoy et al. | 166/68 |
| 4,610,308 | 9/1986 | Meek | 166/321 |
| 4,706,746 | 11/1987 | White et al. | 166/106 |
| 5,028,217 | 7/1991 | Miller | 417/415 |
| 5,040,597 | 8/1991 | Huber et al. | 166/55.1 |

FOREIGN PATENT DOCUMENTS

| | | | |
|---|---|---|---|
| 662705 | 5/1979 | U.S.S.R. | 166/107 |

OTHER PUBLICATIONS

Drawings (5 Sheets) for a Rotary Inflate Pump.

"Use of a Downhole Mud Motor as a Pump for Drill-stem Testing," copyright 1982 Article.

"NAVI-PUMP," Brochure by Norton Christensen Drilling Products.

"The Trico Hydraulic Jet Pump," Brochure by Trico Industries.

"SSJ for DST Drill Stem Testing," Brochure by Trico Industries.

"TRW REDA PUMPS Component Description," copyright 1979, Article.

"ESP—The Electrical Submersible Pump," dated Aug., Sep. and Nov. 1982, Article, reprinted from Petroleum Engineer International.

"Vann Systems—The First Word in Experience," Brochure, copyright 1988.

*Primary Examiner*—Hoang C. Dang

*Attorney, Agent, or Firm*—Henry N. Garrana; John H. Bouchard

[57] ABSTRACT

A new pump or injection apparatus is adapted to be connected between a pipe and a valve and is adapted to either pump well fluids from a wellbore or inject fluids into a formation traversed by the wellbore. The valve includes a full bore passage and a surrounding inlet flow channel. The new pump or injection apparatus includes an apparatus responsive to a movement of the pipe in a longitudinal direction for closing the full bore passage of the valve and opening the surrounding inlet flow channel; when the full bore passage is closed and inlet flow channel is opened, a first section rotates circumferentially in response to a circumferential rotation of the pipe; a second section reciprocates back and forth in a longitudinal direction in response to the circumferential rotation of the first section; and a third section either receives the well fluids uphole wellbore and subsequently pushes the received well fluids uphole or injects fluids in the formation traversed by the wellbore in response to the reciprocation of the second section. The full bore passage of the valve optionally enables other tools, such as drill stem test tools suspending by wireline, to pass through the pump apparatus.

28 Claims, 5 Drawing Sheets

FIG. 2
| |
|---|
| FIG. 2a |
| FIG. 2b |
| FIG. 2c |
| FIG. 2d |
| FIG. 2e |
| FIG. 2f |
FIG. 2a
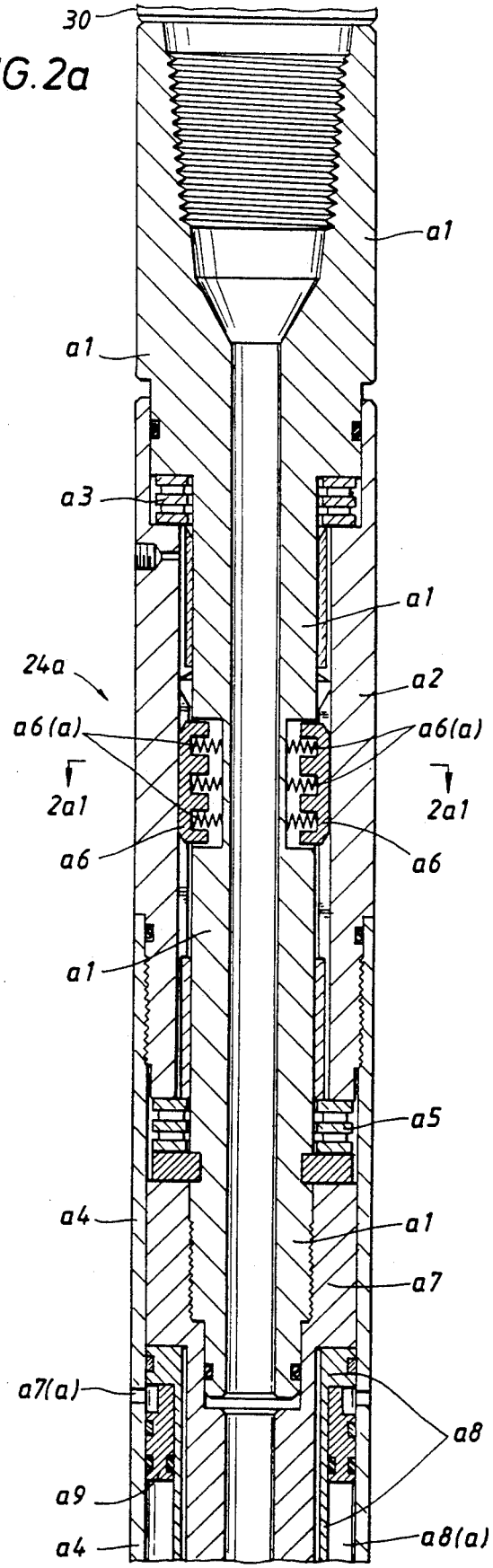
FIG. 2a1
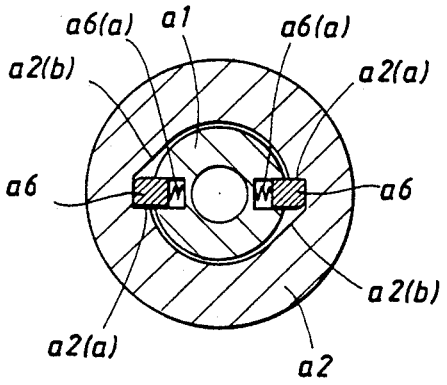

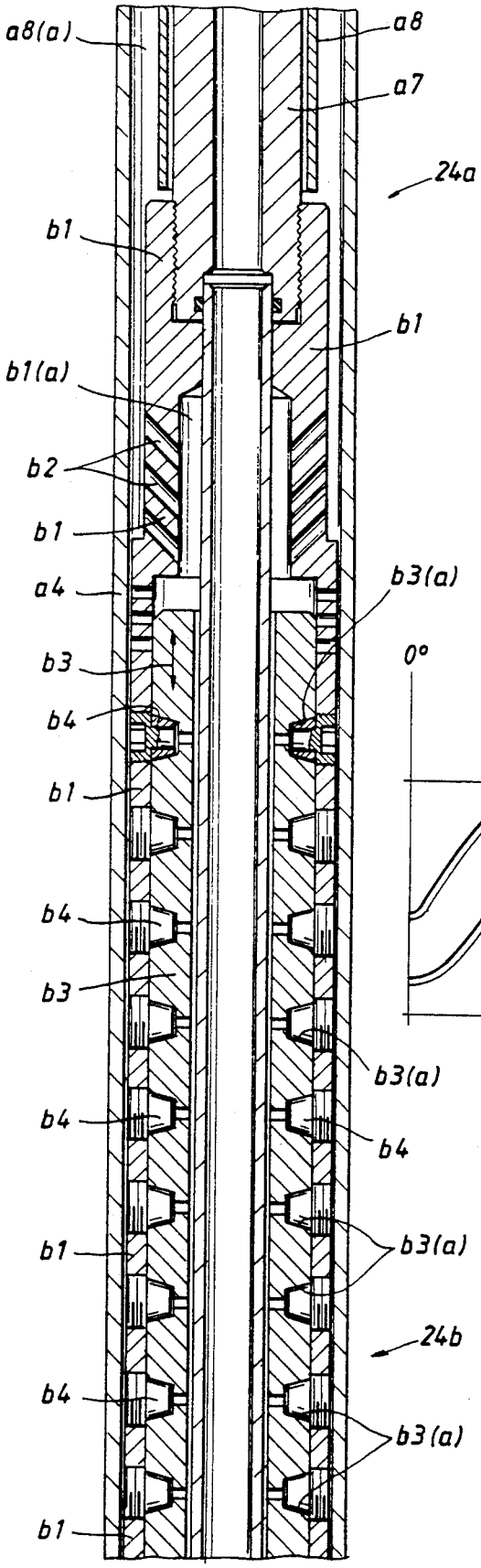
FIG. 2b
FIG. 3
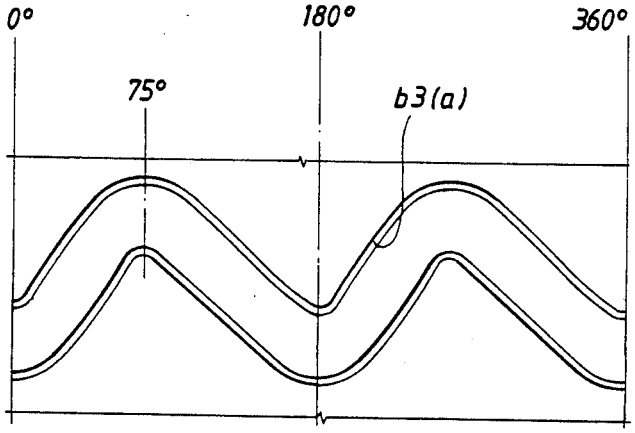

PUMP APPARATUS FOR PUMPING WELL FLUIDS FROM A WELLBORE HAVING LOW FORMATION PRESSURE

BACKGROUND OF THE INVENTION

The subject matter of the present invention relates to a pump apparatus applicable to temporary completion of a well, such as the completion used when testing a well; and more particularly, to a new pump apparatus for pumping well fluids from a wellbore when a pressure of a formation traversed by the wellbore is not high enough to produce the well fluids at a satisfactory rate.

Oil wellbores traverse earth formations. For some wells, the formation pressure is not high enough to produce the well fluids to the well surface at useful rates. As a result, numerous pumping methods are known by those persons skilled in the art, which methods are associated with temporary completion of production wells, such as the completion used when testing a well.

One such pump apparatus is known as the Jet pump. The jet pump has a satisfactory output; however, the effluent that is produced is mixed with a lifting fluid and separation requires additional steps. In addition, the pump has a restricted flow path that can conflict with other phases of the operation. Furthermore, the jet pump requires communication (via the use of ports) between the production string and the annulus around the string in order for the pump to operate. Provision must be made to open and close these ports in order to enable other operations, such as stimulation and tubing conveyed perforation.

Another such pump apparatus is known as the Moineau pump. The Moineau pump generates lower flow rates than the Jet pump.

Furthermore, since it does not provide flow through capability when not activated, the Moineau pump does not allow for the implementation of other possible drill stem test activities.

Still another such pump apparatus, known as the Reda pump, is used primarily in completed wells, and is cumbersome when used in exploratory wells. In addition, it requires the use of electrical generating facilities where an electric cable must be disposed in the wellbore. It is more complex, and restricts the flow path.

Still another pump apparatus, known as the rotary inflate pump, is used to inflate a packer by pumping annulus fluid from a well annulus into a deflated packer via the pump apparatus. The rotary inflate pump operates by circumferentially rotating a top sub; a cam reciprocates in response to the rotation of the top sub; a single longitudinally disposed roller set (a pair of rollers disposed in the same cross-section) connected to the top sub is disposed in one serpentine shaped slot, which slot surrounds the periphery of the cam; as the top sub rotates, the single roller set rides in the single-slot of the cam thereby reciprocating the cam; the cam is connected to a piston; and a pair of check valves are fixedly connected to a housing of the pump, one check valve being an intake check valve communicating with the annulus, the other check valve being an exhaust check valve communicating with the deflated packer; as the cam reciprocates, the piston reciprocates thereby receiving the annulus fluid in the intake check valve during one stroke of the reciprocating piston and exhausting the received annulus fluid to the deflated packer during another stroke of the reciprocating piston. However, since only one serpentine shaped slot or groove is disposed around the periphery of the cam, the single roller set of the top sub disposed in the single slot of the cam limits the output pressure and the flow rate of the annulus fluid being pumped into the deflated packer. In addition, the rotary inflate pump did not pump fluid to the surface of a wellbore, rather, it pumped well fluid from an annulus disposed downhole to a packer also disposed downhole.

Consequently, another pump of different design is needed which overcomes the problems associated with the other above mentioned pumps and which pumps well fluids from wellbores, having low formation pressure, to the wellbore surface.

SUMMARY OF THE INVENTION

Accordingly, it is a primary object of the present invention to provide a new pump apparatus adapted to be disposed in a wellbore having low formation pressure for pumping well fluids from the wellbore to the well surface, the new pump apparatus having an increased output pressure and flow rate relative to the output pressure and flow rate associated with the rotary inflate pump.

It is a further object of the present invention to provide the new pump apparatus having an improved output pressure and flow rate, which pump apparatus is further coupled to a ball valve that can be opened or closed from the surface.

It is a further object of the present invention to provide the new pump apparatus having the improved output pressure and flow rate, which new pump apparatus includes a first section having a plurality of rollers and adapted to be connected to a tubing for rotating circumferentially in response to rotation of the tubing; a second section connected to the first section, adapted to move in a longitudinal reciprocatory fashion in response to the rotation of the first section, and including a cam and a plurality or multitude of serpentine shaped slots or grooves disposed around a periphery of the cam adapted for receiving the respective plurality of rollers; and a third section connected to the reciprocating second section and including a reciprocating valve apparatus for receiving the well fluids from the wellbore and subsequently pushing the received well fluids uphole to a surface of the wellbore in response to the longitudinal reciprocatory movement of the cam of the second section.

It is a further object of the present invention to provide the new pump apparatus having the reciprocating valve apparatus, where the valve apparatus includes a reciprocating first valve connected to the reciprocating cam and adapted to reciprocate in response to the reciprocation of the cam and a second valve fixedly connected to a housing of the pump apparatus, the well fluid being initially received in a chamber disposed between the first and second valve and being subsequently received in the first valve and pushed uphole to the surface of the wellbore during the reciprocating movement of the first valve, the output pressure of the well fluid that is pushed uphole being increased, relative to the output pressure of the well fluid in the rotary inflate pump, primarily as a result of the number (the plurality) of serpentine shaped slots disposed around the periphery of the cam.

It is a further object of the present invention to provide the new pump apparatus adapted to be disposed in the wellbore where the second section includes a restraining means for preventing the second section from moving circumferentially but allowing the second section to move in the longitudinal reciprocatory fashion.

It is a further object of the present invention to provide the new pump apparatus having the improved output pressure and flow rate which further includes a fourth section connected to the third section including a further valve means, such as a ball valve, which opens to create a full bore opening through said pump apparatus or closes to create a closed non-full bore opening through said pump apparatus, the further valve means optionally enabling other tools suspended by wireline to pass through the pump apparatus. The full bore opening also allows drill stem type testing to be performed with the pump in the wellbore. The test may be run before pumping to determine actual formation parameters.

In accordance with these and other objects of the present invention, a new pump apparatus is adapted to be disposed in a wellbore, particularly those wellbores having low formation pressure. The new pump apparatus is coupled with another valve, such as a ball valve, that can be opened or closed from the wellbore surface. When the ball valve is open, there is a free path through the pump assembly. When the ball valve is closed, the pump can then be activated. The low pressure inlet of the pump apparatus is disposed below the ball valve, and the high pressure outlet of the pump apparatus is disposed above the ball valve. The new pump apparatus of the present invention is a fixed displacement reciprocating pump. As a result of the new design of the new pump apparatus of the present invention, the new pump apparatus is able to produce well fluid at thirty (30) gallons per minute at 3000 psi differential pressure, whereas the rotary inflate pump typically produces well fluid at less than one (1) gallon per minute at 1000 psi differential pressure. In addition, the new pump apparatus is full bore thereby providing an unrestricted path through the pump when the pump is not activated thereby allowing other services, such as drill stem testing or stimulations, to be performed.

The new pump apparatus includes a first section adapted to be connected to a tubing for rotating circumferentially in response to rotation of the tubing, a second section connected to the first section and adapted to move in a longitudinal reciprocatory fashion in response to the rotation of the first section, and a third section connected to the second section and including a valve means for receiving the well fluids from the wellbore and subsequently pushing the received well fluids uphole in response to the longitudinal reciprocatory movement of the second section. The second section includes a cam having a plurality of serpentine shaped slots or grooves disposed around its periphery for receiving a corresponding plurality of rollers. In view of the plurality of grooves disposed around the periphery of the cam, the output pressure of the well fluid being pumped to the well surface is increased relative to the output pressure of the well fluid being pumped to inflate the downhole packer in the rotary inflate pump, where only one such serpentine shaped slot or groove is used. A restraining means for preventing the second section from moving circumferentially but it allows the second section to move in the longitudinal reciprocatory fashion The third section includes a first movably oriented check valve which reciprocates with the reciprocating movement of the cam of the second section and a second fixedly oriented check valve which is fixed to the pump housing; the reciprocating movement of the first check valve pumps the well fluids being received in the second check valve to a surface of the wellbore. The new pump apparatus further includes a fourth section connected to the third section including a further valve means, such as a ball valve, which opens to create a full bore opening through said pump apparatus or closes to create a closed non-full bore opening through said pump apparatus, the further valve means optionally enabling other tools suspended by wireline to pass through the pump apparatus.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 2*a* through 2*f* illustrate the new pump apparatus of FIG. 1 in accordance with the present invention;

FIG. 2*a*1 illustrates a cross section of the pump apparatus of FIG. 2*a* taken along section lines 2*a*1—2*a*1 of FIG. 2*a;*

FIG. 3 illustrates, in flat section, the shape of one of a plurality of serpentine grooves disposed in the other periphery of the cam, a part of the second section of the new pump apparatus which reciprocates longitudinally in response to rotational movement of the first section.

DETAILED DESCRIPTION OF THE PREFERRED EMBODIMENT

Figure 1:
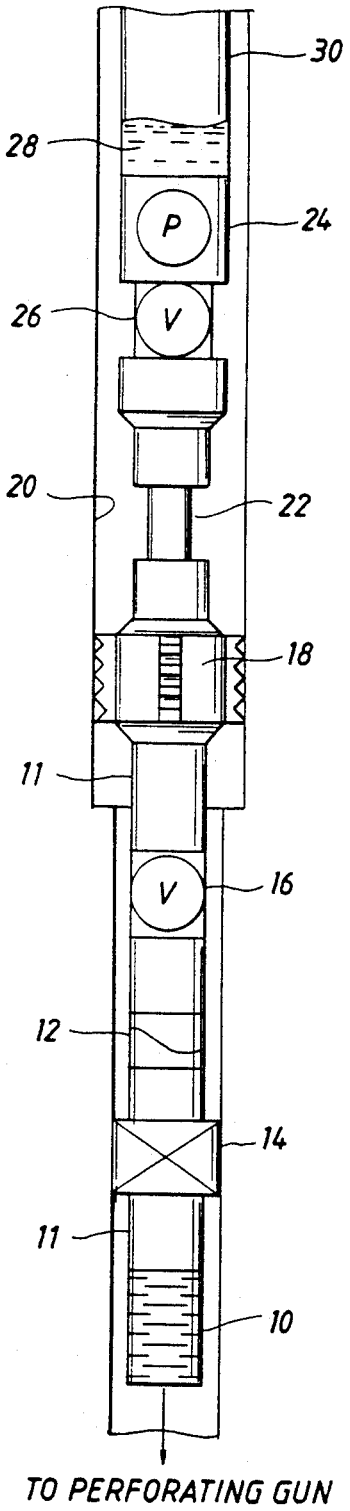
FIG. 1 illustrates a perforating and drill stem test string disposed in a borehole including a new pump apparatus in accordance with the present invention.

Referring to FIG. 1, a perforating and drill stem test string is disposed in a borehole.

In FIG. 1, the string is comprised of a screen 10, such as a slotted tail pipe, connected to tubing 11 and adapted to be connected to a perforating gun, the tubing 11 being connected to a set packer 14, the packer 14 being connected to a safety joint 12. The safety joint 12 disconnects the tubing from an object stuck downhole, such as the packer 14, in response to a counterclockwise rotation of pipe 30, as noted in FIG. 2*a*1 of the drawings and discussed later in this specification. Another typical safety joint is described in prior pending application Ser. No. 07/722,041, filed Jun. 27, 1991, entitled "Apparatus for Releasing a Pipe String from an Object Stuck Downhole by Continuously Applying Tension to said Apparatus", the disclosure of which is incorporated by reference into this specification. A test valve 16 is connected to the safety joint 12 (perhaps separated by a Jars tool), the test valve 16 opening or closing to either allow or preclude the well fluids from flowing uphole within the tubing 11 from the producing formation. A full bore slip joint 22 is connected to the test valve 16 via tubing 11, and an anchor 18 firmly anchors the string of FIG. 1 to a wall of the borehole 20. A pump apparatus 24 in accordance with the present invention is connected to a valve 26, such as a ball valve 26, on one end and to pipe 30 on the other end. The pipe 30 is adapted to rotate circumferentially, initiating the operation of pump 24. The anchor 18 prevents the second section of the pump apparatus 24 from rotating circumferentially in response to the circumferential rotation of the first section of the pump apparatus 24. In operation, when valve 26 is open, a full bore allows the well fluids, such as oil, 28 to flow to the surface, otherwise, if the valve 26 is closed, there being no full bore, the pump 24 can still pump the well fluids to the surface. If the formation traversed by borehole 20 has a low formation pressure, the low pressure may not be high enough to push the well fluids to the surface of the borehole. Consequently, if the valve 26 is open, the well fluids will not rise to the surface of the borehole. When this happens, the valve 26 is closed and the pump 24 pumps the well fluids to the well surface.

Referring to FIG. 2, inclusive of FIGS. 2*a*–2*f*, a cross sectional view of the pump 24 is illustrated.

Figure 2F:
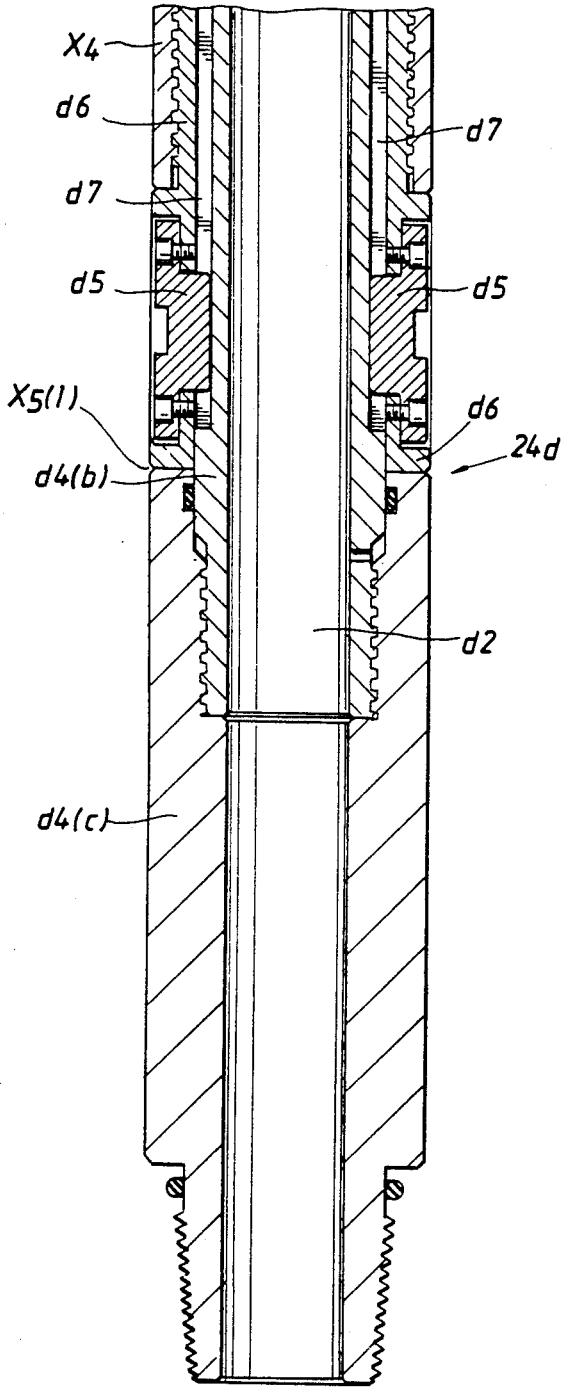
Figure 2C:
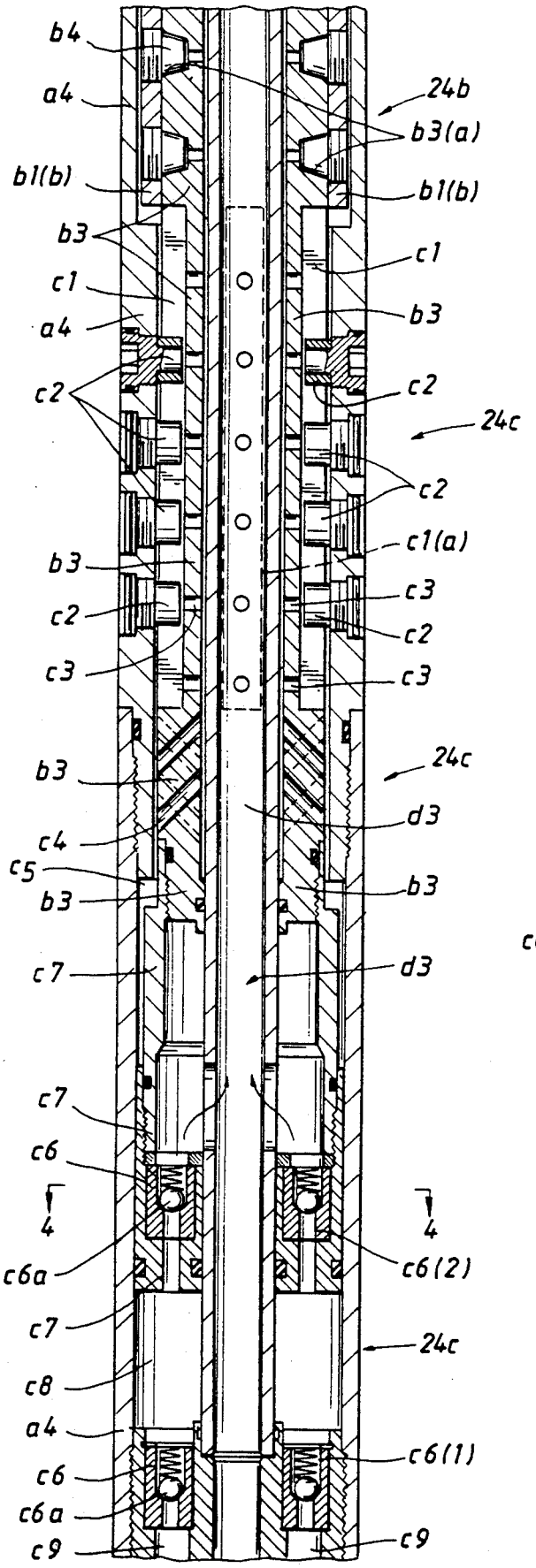
Figure 2D:
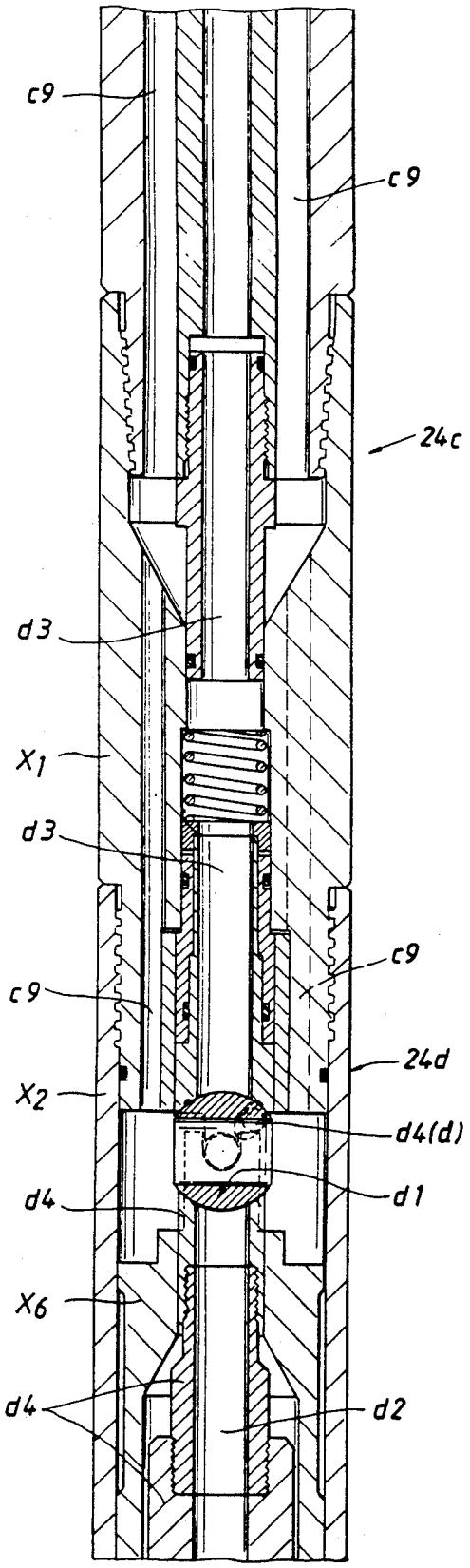
Figure 2E:
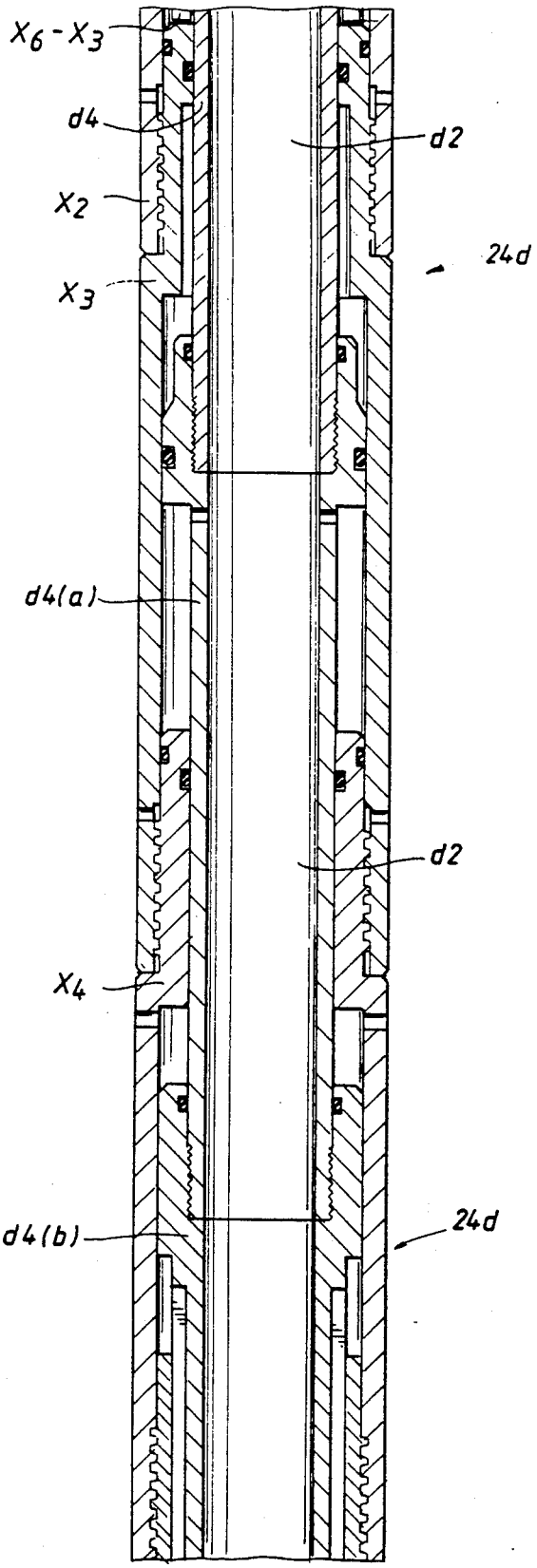

The pump 24 includes a first section 24*a* as shown in FIGS. 2*a*–2*b*, a second section 24*b* as shown in FIGS. 2*b*–2*c*, a third section 24*c* as shown in FIGS. 2*c*–2*d*, and a fourth section 24*d* as shown in FIGS. 2*d*–2*f*.

Referring to FIGS. 2*a*–2*b*, the first section 24*a* of pump 24 includes a top sub a1 adapted to be connected to the pipe 30. When the pipe 30 rotates circumferentially, the top sub a1 also rotates. A thrust sub a2 is sealingly connected to the top sub a1 via a seal. The thrust sub a2 is fixed in position. A set of bearings a3 are disposed between the thrust sub a2 and top sub a1 thereby allowing the top sub to rotate circumferentially relative to the thrust sub. A first housing a4 is connected to the thrust sub a2 and another set of bearings a5 are disposed between the thrust sub a2, the first housing a4 and the top sub a1 for enabling the top sub a1 to rotate circumferentially relative to the thrust sub a2 and the first housing a4. A set of torque keys a6 are fixedly disposed around the outer periphery of the top sub a1 and are biased outwardly against the thrust sub a2, the keys a6 functioning as a one-way (clockwise or right hand) rotational limiter. Left hand or counterclockwise rotation of the torque keys a6 backs off the safety joint 12 thereby allowing the tubing 11 to be disconnected from an object stuck downhole, such as the packer 14.

Referring to FIG. 2*a*1, a cross section of the pump apparatus 24 of FIG. 2*a*, taken along section lines 2*a*1—2*a*1 of FIG. 2*a*, is illustrated. In FIG. 2*a*1, a pair of torque keys a6 are each biased by a spring a6(*a*) against thrust sub a2. The thrust sub a2 includes a pair of shoulders a2(*a*) against which the torque keys a6 initially rest. If the top sub a1 is rotated counterclockwise, each of the torque keys a6 abut against the shoulder a2(*a*) of the thrust sub a2, and, as a result, the top sub a1 is not permitted to rotate counterclockwise. However, the thrust sub a2 rotates counterclockwise thereby backing off the safety joint 12 and disconnecting the tubing 11 from an object, such as packer 14, stuck downhole. If, on the other hand, the top sub a1 is rotated clockwise, the torque keys a6 do not abut against a shoulder, rather, the keys a6 ride along ridge a2(*b*) of thrust sub a2; and, as a result, the top sub a1 is permitted to rotate clockwise. Hereinafter, any reference to circumferential rotation of top sub a1, further sub a7, and cam actuator b1 refers to clockwise rotation, since the torque keys a6 associated with top sub a1 are prevented from rotating counterclockwise.

In FIG. 2*a*, a further sub a7 is connected to the top sub a1 and is disposed within the first housing a4, the further sub a7 rotating clockwise in synchronism with the clockwise circumferential rotation of the top sub a1. A piston a8 is disposed around the further sub a7 and within the first housing a4 thereby defining a space a8(*a*) between the first housing a4 and the piston a8. A port a7(*a*) is disposed through the first housing a4 and a compensating piston a9 is disposed within the space a8(*a*). The space a8(*a*) is filled with a lubricant, such as oil, and the port a7(*a*) is adapted to communicate well annulus fluid, at hydrostatic pressure, to one end of the compensating piston a9. The hydrostatic pressure of the well annulus fluid is exerted on the compensating piston a9 via port a7(*a*), and, in response, the compensating piston a9 exerts a corresponding pressure on the oil disposed within space a8(*a*).

Referring to FIGS. 2*b*–2*c*, the second section 24*b* of the pump 24 includes a cam actuator b1 connected to an end of the further sub a7. A plurality of ports b2 are disposed through the cam actuator b1 for communicating the oil in space a8(*a*) to an internal part b1(*a*) of the cam actuator b1. Since the further sub a7 rotates, and the cam actuator b1 is connected to the further sub a7, the cam actuator b1 also rotates circumferentially in synchronism with the rotation of the further sub a7. A cam b3 is disposed within the internal part b1(*a*) of the cam actuator b1. The cam b3 is adapted to move longitudinally within the cam actuator b1, but is not adapted to rotate circumferentially. A plurality of tapered rollers b4 are connected to the cam actuator b1, the rollers b4 pointing inwardly toward the cam b3. Since the rollers b4 are connected to the cam actuator b1, the rollers b4 rotate in synchronism with the circumferential rotation of the cam actuator b1. A plurality of grooves b3(*a*), in accordance with one aspect of the present invention, are disposed in the outer periphery of the cam b3, each groove being adapted to receive two (2) of the plurality of tapered rollers b4. Each groove of the plurality of grooves b3(*a*) assumes the same shape. As the cam actuator b1 rotates circumferentially, the tapered rollers b4 also rotate circumferentially. Since the plurality of rollers b4 are disposed within the plurality of grooves b3(*a*), respectively, in the cam b3, the circumferential rotation of the plurality of rollers b4 in response to rotation of the cam actuator b1 causes the cam b3 to move in a fashion which is determined by the shape of the grooves b3(*a*) disposed in the outer periphery of cam b3.

The number (i.e., the plurality) of grooves or slots b3(*a*) disposed around the periphery of the cam b3, which receives a corresponding number of rollers b4 connected to the cam actuator b1, increases the output pressure of the well fluids pumped to the surface of the wellbore relative to the output pressure of the annulus fluid pumped into the deflated packer associated with the rotary inflate pump mentioned in the background section of this specification. The rotary inflate pump had only one groove or slot in its cam. Since there was only one such groove or slot, this limited the output pressure of the pumped annulus fluid. The use of a plurality or multitude of such grooves or slots b3(*a*) in the cam b3 of the new pump apparatus of the present invention increases the output pressure of the well fluid pumped to the wellbore surface.

In FIG. 3, the shape of one of the plurality of grooves b3(*a*) is illustrated. As illustrated in FIG. 3, in the preferred embodiment, each groove b3(*a*) has a serpentine shape. The specific shape of each groove b3(*a*) in cam b3 is defined as follows: for each 360 degree traversal of the serpentine grove, there exists a 75 degree rise from a lower axis to an apex of the groove, followed by a 105 degree fall back to the lower axis signifying completion of 180 degrees, followed by another 75 degree rise to the apex, followed by another 105 degree fall back to the lower axis signifying completion of 360 degrees, etc. The shape of each groove b3(*a*) in the outer periphery of cam b3 is important in defining the specific movement of the cam b3 in response to rotation of the tapered rollers b4. Since each groove b3(*a*) is serpentine in shape, as illustrated in FIG. 3, when the rollers b4 rotate clockwise in response to the clockwise rotation of the cam actuator b1, the cam b3 will then move longitudinally "back and forth" within the first housing a4. A single reciprocating "back and forth" movement of the cam b3 consists of an up movement followed by a down movement of the cam and is hereinafter termed a "longitudinal cycle". In fact, due to the specific shape of the grooves b3(*a*) in the cam b3 in the preferred embodiment, when the rollers b4 complete one circumferential rotation in response to the one circumferential rotation of cam actuator b1 and pipe 30, the cam b3 completes two longitudinal cycles. The oil in space a8(*a*), which flowed through ports b2 into the internal part b1(*a*) of the cam actuator b1 of FIG. 2*b*, lubricates the cam b3 during the completion of its reciprocating longitudinal cycles.

Referring to FIG. 2*c*, an end piece b1(*b*) of cam actuator b1 is the last piece of the cam actuator b1 in this description to rotate circumferentially.

Referring to FIGS. 2*c*–2*d*, the third section 24*c* of the pump 24 includes four longitudinally disposed slots cl, each of which are formed in the cam b3 and are disposed around the periphery of the cam b3. The longitudinally disposed slots cl are better visualized by locating slot c1(*a*) in FIG. 2*c*; numeral c1(*a*) illustrates a slot which is positioned approximately 90 degrees relative to slot c1. A plurality of roller bearings c2 protrude into each slot c1; the roller bearings c2 are fixed in position within their slots c1. As the cam b3 moves back and forth in a reciprocating fashion during completion of its longitudinal cycles, the roller bearings c2 protrude within the slots c1 thereby allowing the cam b3 to move longitudinally but preventing and restraining the cam b3 from moving circumferentially. A plurality of ports or holes c3 are disposed through the cam b3 within the third section 24*c* of pump 24; these holes c3 allow the oil which originated from space a8(*a*) in FIG. 2*a* to flow into the slots c1 thereby lubricating the slots c1 during the reciprocating movement of cam b3 relative to roller bearings c2 (the slot must be lubricated due to the relative movement of roller bearings c2 in slot c1). A further plurality of ports or holes c4 are also disposed through the cam b3, as shown in FIG. 2*c*, to allow the same oil to flow into a further space c5. As will be understood below, the further space c5 communicates with the valve means referenced in the summary section of this application, the valve means receiving the well fluids from the wellbore and subsequently pushing the received well fluids uphole in response to the reciprocatory movement of the second section 24*b* of pump 24.

The valve means actually comprises a check valve c6 including a plurality of fixed inlet check valves c6(1) disposed adjacent a corresponding plurality of inlet flow channels c9 and a respective plurality of movable outlet check valves c6(2), each inlet and outlet check valve having a ball c6*a* disposed within a seat. The ball c6*a* of each check valve c6(1) and c6(2) moves into and out of its seat; the ball of outlet check valve c6(2) moves into and out of its seat in response to pressure of well fluid in a pump chamber c8 during movement of cam b3; the ball of inlet check valve c6(1) moves out of its seat in response to the pressure of well fluid flowing in the inlet flow channels c9. The inlet check valve c6(1) is fixedly, threadedly connected to the first housing a4 whereas the outlet check valve c6(2) is movably connected to cam b3. The outlet check valve c6(2) is connected to the cam b3 ]ia a pump piston c7; as the cam b3 and attached pump piston c7 complete a reciprocating longitudinal cycle, the outlet check valve c6(2) also completes its own corresponding longitudinal cycle (the check valve c6(2) moves up and down corresponding to the up and down movement of cam b3 and pump piston c7), and the ball c6*a* moves into and out of its seat correspondingly, as will be described in more detail later in this specification. A pumping chamber c8 is disposed between the inlet check valve c6(1) and the outlet check valve c6(2). The pumping chamber c8 temporarily stores the well fluid during the reciprocating movement of the outlet .check valve c6(2) in response to the reciprocating movement of the cam b3.

Figure 4:
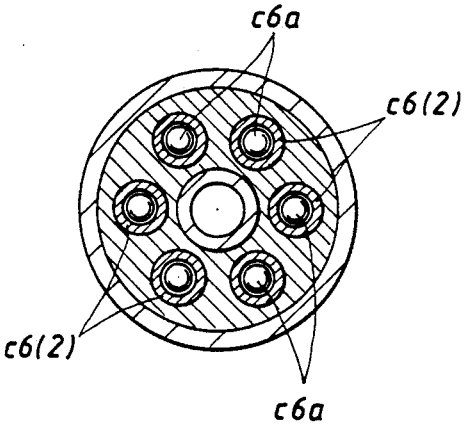
FIG. 4 is a cross sectional view of the new pump apparatus taken along section lines 4—4 of FIG. 2*c*.

Referring to FIG. 4, a cross sectional view of pump 24 taken along section lines 4—4 of FIG. 2*c* is illustrated, this view illustrating six outlet check valves c6(2) equally spaced from one another and disposed around the periphery of the pump 24. Six inlet check valves c6(1), corresponding, respectively, to the six outlet check valves c6(2), are also equally spaced from one another and disposed around the periphery of the pump 24. The inlet check valves c6(1) are constructed the same, in cross section, as the outlet check valves c6(2). Each check valve c6(1) and c6(2) includes a ball c6(*a*) seated in its own seat. Well fluid from the pumping chamber c8 unseats the ball c6(*a*) in each of the six outlet check valves c6(2) thereby flowing through the outlet check valves c6(2) into a second full bore section d3 in response to the reciprocating movement of the pump piston c7.

Referring to FIGS. 2*d*–2*f*, the fourth section 24*d* of the pump 24 is comprised primarily of a closure apparatus which includes another, further valve d1, such as a ball valve d1 and inlet flow channels c9 (for purposes of this description, valve d1 in FIG. 2*d* and valve 26 of FIG. 1 are the same valve). When the ball valve d1 is open, well fluid, flowing uphole in a first full bore section d2 from a producing formation of flow pressure, will continue to flow through the ball valve d1 and into the second full bore section d3. However, if the ball valve d1 is closed, the well fluid flowing uphole in the first full bore section d2 cannot flow through the ball valve d1 and into the second full bore section d3; consequently, when the ball valve d1 is closed, the well fluid is diverted from first full bore section d2 into the inlet flow channels c9, which ultimately lead to the inlet check valves c6(1). A yoke d4 includes a pin d4(*d*), the yoke d4 being connected by the pin d4(*d*) to the ball valve d1. The yoke d4 is also connected to other yoke sections d4(*a*), d4(*b*), and d4(*c*). A set of outer housings X1, X2, X3, X4, and d6 are all serially connected to one another and all surround and enclose the yoke d4 and other yoke sections d4(*a*) and d4(*b*). A ball cage X6 in FIG. 2*d* is disposed between yoke d4 and outer housing X2, the lower end of the ball cage X6 being in contact with the upper end (or shoulder) of outer housing X3 at point X6-X3 in FIG. 2*e*. The other yoke section d4(*c*) is connected to other yoke section d4(*b*) and is co-extensive with outer housing d6, in FIG. 2*f*. In fact, as noted in FIG. 2*f*, the other yoke section d4(*c*) and the outer housing d6 meet at a common point X5(1). In FIG. 2*f*, a pair of torque keys d5 are fixedly disposed around the outer housing d6 of the pump but the keys d5 are adapted to ride within another slot d7. In operation, housings X1, X2, X3, X4, d6, ball cage X6, and ball valve d1 are all adapted to move up and down; however, pin d4(*d*), yoke d4, and other yoke sections d4(*a*), d4(*b*), and d4(*c*) are all stationary, that is, they are fixed in position since they are all fixed to stationary packer 14. When a user at the well surface pulls upwardly on the top sub a1, outer housing d6 separates from the other yoke section d4(*c*) at common point X5(1); the keys d5 move within the slot d7. The movement of outer housings X1–X4 and d6 upwardly causes the shoulder or upper end of outer housing X3 to meet at point X6-X3 and lift ball cage X6 upwardly. When the ball cage X6 is lifted upwardly, the ball d1 is also lifted upwardly. Pin d4(*d*) of the yoke d4 is fixed, but the ball itself d1 is lifted upwardly causing the ball valve d1 to open or close, accordingly.

A functional description of the pump 24 of the present invention will be set forth in the following paragraphs with reference to FIG. 2 of the drawings.

Assume that the perforating and drill stem testing string of FIG. 1 is disposed in a wellbore and that the perforating gun has perforated a formation traversed by the wellbore. Assume further that the formation pressure of the well fluid flowing from the perforated formation exceeds a predetermined threshold pressure value. Since the formation pressure is greater than the threshold pressure value, the well fluid pressure is high enough to push the well fluid to the well surface. Therefore, in order to flow the well fluid to the wellbore surface, one need only open test valve 16 and open ball valve 26 (the same as ball valve d1). However, if the formation pressure is less than the threshold pressure value, the well fluid pressure is not high enough to push the well fluid to the well surface. Therefore, in order to flow the well fluid to the wellbore surface, the well fluid must be pumped to the surface. Pump 24 functions to pump this well fluid to the surface of the well. The operator at the well surface closes the ball valve d1 of FIG. 2*d* by either pulling up on the pipe 30 or pushing down on the pipe 30. When a user at the well surface pulls upwardly on pie 30, a pull upwardly is exerted on the top sub a1; and, as noted in FIG. 2*f*, outer housing d6 separates from the other yoke section d4(*c*) at common point X5(1), and the keys d5 move within the slot d7. The movement of outer housings X1–X4 and d6 upwardly causes the shoulder or upper end of outer housing X3 to meet at point X6-X3 and lift ball cage X6 upwardly. When the ball cage X6 is lifted upwardly, the ball d1 is also lifted upwardly. Pin d4(*d*) of the yoke d4 is fixed, but the ball itself d1 is lifted upwardly causing the ball valve d1 to close.

Now that the ball valve d1 (26 in FIG. 1) is closed, and the well fluid is waiting at the input of inlet check valve c6(1), the operator at the well surface circumferentially rotates the pipe 30 in FIG. 1 in the clockwise direction. When the pipe 30 rotates circumferentially, as noted in FIGS. 2*a*–2*c*, the top sub a1, the further sub a7, and the cam actuator b1 all rotate circumferentially in synchronism with rotation of the top sub a1. Since a plurality of the tapered rollers b4 are connected to the cam actuator b1, the plurality of tapered rollers b4 also rotate circumferentially. The tapered rollers b4 are tapered, and the taper of each roller b4 is disposed in its own groove b3(*a*). Recall that, in accordance with one aspect of the present invention, the cam b3 has a plurality of grooves b3(*a*) disposed around its outer periphery, one groove b3(*a*) for each two disposed rollers b4, each of the plurality of grooves b3(*a*) assuming an approximately sinusoidal shape as illustrated in FIG. 3 when the cam b3 is cut along its side and laid flat in a flat section. Thus, when the cam actuator b1 rotates circumferentially in the clockwise direction, the tapered rollers b4 also rotate circumferentially; but, since each roller is disposed in its own groove b3(*a*), and since each groove assumes an approximately sinusoidal shape as shown in FIG. 3, the circumferential rotation of tapered rollers b4 causes the cam b3 to move along a longitudinal axis of the pump 24 in a reciprocating "back and forth" fashion. Since there are a plurality of the grooves b3(*a*) and a corresponding plurality of rollers b4, the output pressure of the well fluids being pumped to the surface of the wellbore is higher than the output pressure of the well fluids pumped into the deflated packer associated with the rotary inflate pump mentioned in the Background section of this specification. For each circumferential rotation of top sub a1 and cam actuator b1 and tapered roller b4, two longitudinal cycles of the cam b3 are completed, where a longitudinal cycle consists of an up stroke by cam b3 followed by a down stroke by cam b3. For lubrication purposes, the hydrostatic pressure of the well fluid in an annulus section of the wellbore is exerted on compensating piston a9 of FIG. 2*a* via port a7(*a*). The compensating piston a9 exerts a corresponding pressure on the oil in space a8(*a*); the oil flows from space a8(*a*) into ports b2 of FIG. 2*b* and into the internal part b1(*a*) of cam actuator b1 thereby lubricating the cam b3 during its reciprocating "back and forth" movement. The oil ultimately flows into ports c3 of FIG. 2*c*, and into slots c1 for lubricating the slot during the relative movement of roller bearings c2 in the slot c1 (actually, the roller bearings c2 remain fixed and the cam b3, which forms the slot c1, reciprocates back and forth). Since the roller bearings c2 are disposed in their respective slots c1, the cam b3 cannot rotate circumferentially, rather, the cam b3 can only reciprocate back and forth for completing its longitudinal cycle. The oil also flows into the further plurality of ports or holes c4 for lubricating a seal surrounding the outlet check valve c6(2) during its reciprocating back and forth movement in synchronism with the reciprocating back and forth movement of the cam b3.

As already noted, since the outlet check valve c6(2) is connected to cam b3, as the cam b3 reciprocates back and forth longitudinally, the outlet check valve c6(2) also reciprocates back and forth longitudinally. In addition, as noted previously in this description, oil or well fluid is disposed in the inlet flow channel c9 of FIG. 2*c* and is waiting at the input of the inlet check valve c6(1). The pressure of this well fluid, being greater than the pressure of the well fluid in pump chamber c8, causes ball c6*a* of the inlet check valve c6(1) to move off of its seat thereby allowing the well fluid to enter the pump chamber c8. Well fluid now sits inside the pump chamber c8 of FIG. 2cHowever, the outlet check valve c6(2) is reciprocating back and forth in response to reciprocation of cam b3 during completion of its longitudinal cycles; therefore, during each down stroke of the outlet check valve c6(2), the ball c6a of outlet check valve c6(2) is lifted off its seat thereby allowing the well fluid in pump chamber c8 to move into the second full bore section d3. During the next following up stroke of the outlet check valve, well fluid in the inlet flow channel c9 moves through the inlet check valve c6(1) and into pump chamber c8. During the next following down stroke of the outlet check valve c6(2), the ball c6a of the outlet check valve c6(2) is lifted off its seat thereby allowing the well fluid in pump chamber c8 to again move into the second full bore section d3, etc. the well fluid moves up the full bore section d3 to the well surface. This pattern of reciprocation of cam b3/outlet check valve c6(2) and the corresponding movement of well fluid from inlet flow channels c9 into pump chamber c8 and from pump chamber c8 into full bore section d3 to the well surface continues during the pumping operation of pump 24.

As a result of the new design of the new pump apparatus of the present invention, the new pump apparatus is superior to the rotary inflate pump or any other pump apparatus of the prior art. For example, the rotary inflate pump is able to produce well fluid at less than one (1) gallon per minute at 1000 psi differential pressure, whereas the new pump apparatus of the present invention is able to produce well fluid at thirty (30) gallons per minute at 3000 psi differential pressure. In addition, the new pump apparatus is full bore thereby providing an unrestricted path through the pump when the pump is not activated; this full bore feature enables other drill stem test activities to take place.

The present embodiment of the new pump apparatus of the present invention is shown pumping fluid from the formation to the surface; however, it is obvious that a similar configuration can be used to inject fluid into the formation. In this case, the low pressure inlet of the pump would be disposed above the ball valve and the outlet would be disposed below the ball valve. This can be useful when a known quantity of fluid must be injected in the formation, for, for example, "in situ" stress measurement. As the pump displaces an amount of fluid proportional to the number of rotations of the pipe, the amount of fluid injected can be measured by counting the number of pipe rotations.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A pump apparatus adapted to be connected between a pipe and a closure apparatus in a wellbore containing fluids under pressure, comprising:

first means responsive to a longitudinal movement of said pipe for changing a closure condition of said closure apparatus;

second means responsive to a circumferential rotation of said pipe for rotating in a circumferential direction when said first means changes the closure condition of said closure apparatus, said second means includng a plurality of objects, said plurality of objects being adapted to rotate in response to the rotation of said second means;

third means connected to the second means for reciprocating in a longitudinal direction in response to the circumferential rotation of said second means, said third means including a plurality of receiving means for receiving, respectively, said plurality of objects, the rotation of said plurality of objects when received in the respective plurality of receiving means reciprocating said third means; and fourth means connected to the third means and adapted to reciprocate in response to the reciprocation of said third means for receiving said fluids during one part of the reciprocation of said fourth means and for pushing said fluids to a surface of said wellbore during a remaining part of the reciprocation of said fourth means.

2. The pump apparatus of claim 1, wherein the plurality of objects include a plurality of rollers, the plurality of receiving means being a plurality of grooves for receiving, respectively, said plurality of rollers.

3. The pump apparatus of claim 1, wherein said third means comprises:

restraining means for preventing said third means from rotating int he circumferential direction during its reciprocation in the longitudinal direction.

4. A pump apparatus adapted to be connected to a pipe on one end, adapted to be connected to a valve on the other end, and adapted to be disposed in a wellbore containing well fluids, comprising:

first means responsive to a longitudinal movement of said pipe for closing said valve; and second means responsive to a rotational movement of said pipe for pushing said well fluids to a surface of said wellbore when said valve is closed by said first means, said second means including, rotating means responsive to the rotational movement of said pipe for rotating in a circumferential direction, said rotating means including a plurality of rollers, said plurality of rollers being adapted to rotate in response to the rotation of said rotating means, reciprocating means connected to the rotating means for reciprocating in a longitudinal direction in response to the circumferential rotation of said plurality of rollers, said reciprocating means including a plurality of slots for receiving, respectively, said plurality of rollers, the rotation of said plurality of rollers when received in the respective plurality of slots reciprocating said reciprocating means, and valve means connected to the reciprocating means for reciprocating in the longitudinal direction during the reciprocation of said reciprocating means, said valve means receiving said fluids during one part of the reciprocation of said valve means and pushing said fluids to a surface of said wellbore during a remaining part of the reciprocation of said valve means.

5. The pump apparatus of claim 4, wherein said first means comprises:

a yoke fixedly connected to one part of said valve; and an outer housing movably connected to another part of said valve and to said pipe, the longitudinal movement of said pipe producing a corresponding longitudinal movement of said outer housing, the longitudinal movement of said outer housing producing a corresponding movement of said another part of said valve relative to said one part of said valve, the movement of said another part of said valve relative to said one part of said valve closing said valve.

6. The pump apparatus of claim 4, wherein said reciprocating means of said second means comprises:

cam means having said plurality of said slots disposed around an outer periphery of said cam means for receiving said plurality of rollers of said rotating means in said plurality of slots and for reciprocating in a longitudinal direction when said plurality of rollers rotate in response to the rotation of said rotating means.

7. The pump apparatus of claim 6, wherein said first means comprises:

a yoke fixedly connected to one part of said valve; and an outer housing movably connected to another part of said valve and to said pipe, the longitudinal movement of said pipe producing a corresponding longitudinal movement of said outer housing, the longitudinal movement of said outer housing producing a corresponding movement of said another part of said valve relative to said one part of said valve, the movement of said another part of said valve relative to said one part of said valve closing said valve.

8. In a pump apparatus including a first section having a plurality of objects and a second section having a plurality of receiving means for receiving, respectively, said plurality of objects of said first section, the pump apparatus being adapted to be connected between a pipe and a valve and disposed in a wellbore containing well fluids under pressure, said valve including a full bore opening and one or more inlet flow channels, a method of pumping said well fluids from said wellbore, comprising the steps of:

moving said first section and said second section in a longitudinal direction in response to a corresponding movement of said pipe in said longitudinal direction thereby closing said full bore opening and opening said one or more inlet flow channels;

after said full bore opening is closed and said one or more inlet flow channels is opened, rotating in a circumferential direction said plurality of objects of said first section when said plurality of objects are received in their respective plurality of receiving means in said second section;

reciprocating in a longitudinal direction said second section of said pump apparatus in response to the circumferential rotation of said plurality of objects; and pumping said well fluids from said wellbore in response tot he reciprocation of said second section in the longitudinal direction.

9. The method of claim 8, further comprising the step of:

preventing said second section from rotating in the circumferential direction during the reciprocation of said second section in the longitudinal direction.

10. The method of claim 8, wherein a valve means is connected to said second section and is adapted to reciprocate in response to reciprocation of said second section, and a chamber is disposed adjacent said valve means, a first portion of said well fluids residing in said chamber, and wherein the pumping step comprises the steps of:

receiving said first portion of said well fluids from said chamber into said valve means during one part of the reciprocation of said valve means; and refilling said chamber with a second portion of said well fluids during another part of the reciprocation of said valve means.

11. The method of claim 8, wherein said first section includes a cam actuator adapted to rotate in the circumferential direction in response to the rotation of said first section, said plurality of objects being a plurality of rollers connected to the cam actuator, said second section including a cam, said plurality of receiving means being a plurality of grooves disposed around a periphery of said cam and adapted to receive said plurality of rollers of said cam actuator, said cam adapted to reciprocate when said plurality of rollers of said cam actuator are received in said plurality of grooves of said cam and said cam actuator rotates in a circumferential direction, and wherein the reciprocating step comprises the step of:

sliding said plurality of rollers of said cam actuator in the respective plurality of grooves of said cam in response to the circumferential rotation of said cam actuator; and reciprocating said cam in the longitudinal direction when the plurality of rollers of said cam actuator are received in the respective plurality of grooves of said cam and said cam actuator rotates int he circumferential direction.

12. The method of claim 11, wherein a valve means is connected to said second section and is adapted to reciprocate in response to reciprocation of said second section, and a chamber is disposed adjacent said valve means, a first portion of said well fluids residing in said chamber, and wherein the pumping step comprises the steps of:

receiving said first portion of said well fluids from said chamber into said valve means during one part of the reciprocation of said valve means; and refilling said chamber with a second portion of said well fluids during another part of the reciprocation of said valve means.

13. A pump apparatus connected between a pipe and a closure apparatus, said closure apparatus having a full bore passage and an inlet flow channel disposed around a periphery of said full bore passage, comprising:

means responsive to a movement of said pipe in a longitudinal direction for closing said full bore passage and opening said inlet flow channel of said closure apparatus;

a first section connected to said pipe and adapted to rotate in a circumferential direction in response to a circumferential rotation of said pipe when said full bore passage is closed and said inlet flow channel is opened, said first section including a plurality of rollers;

a second section connected to said first section and adapted to reciprocate in a longitudinal direction in response to the circumferential rotation of said first section, said second section including a plurality of grooves, said plurality of grooves of said second section being adapted to receive, respectively, said plurality of rollers of said first section; and receiving means disposed adjacent a portion of said fluids, connected to said second section and adapted to reciprocate with the reciprocation of said second section for receiving said portion of said fluids during one part of the reciprocation of said receiving means and pushing said portion of said fluids to a surface of said wellbore during another part of the reciprocation of said receiving means.

14. The pump apparatus of claim 13, wherein said first section comprises a cam actuator adapted to rotate in response to rotation of said pipe, said cam actuator including said plurality of rollers, the rollers rotating in the circumferential direction in response to the circumferential rotation of said cam actuator.

15. The pump apparatus of claim 14, wherein said second section comprises a cam adapted to reciprocate in said longitudinal direction, said cam including said plurality of grooves corresponding, respectively, to said plurality of rollers, each groove in the cam being adapted to receive one of the plurality of rollers of said cam actuator, said cam reciprocating in the longitudinal direction when the plurality of rollers of the cam actuator are received in the plurality of grooves in the cam and the plurality of rollers rotate in the circumferential direction.

16. A pump apparatus of claim 15, wherein the means for closing comprises an outer housing, said receiving means including a first check valve connected to the cam and adapted to reciprocate in the longitudinal direction in response to reciprocation of said cam, and a second check valve fixedly connected to said outer housing and spaced from the first check valve thereby defining a chamber between the first and second check valves, said portion of said fluids being received in said second check valve and passing into said chamber, said portion of said fluids in said chamber being received in said first check valve during one part of the reciprocation of said first check valve and being pushed to a surface of said wellbore during another part of the reciprocation of said first check valve.

17. An injection apparatus adapted to be connected between a pipe and a closure apparatus in a wellbore for injecting fluids into a formation traversed by the wellbore, comprising:

first means responsive to a longitudinal movement of said pipe for changing a closure condition of said closure apparatus;

second means responsive to a circumferential rotation of said pipe for rotating in a circumferential direction when said first means changes the closure condition of said closure apparatus, said second means including a plurality of objects, said plurality of objects being adapted to rotate in response to the rotation of said second means;

third means connected to the second means for reciprocating in a longitudinal direction in response to the circumferential rotation of said second means, said third means including a plurality of receiving means for receiving, respectively, said plurality of objects, the rotation of said plurality of objects when received in the respective plurality of receiving means reciprocating said third means; and fourth means connected to the third means and adapted to reciprocate in response to the reciprocation of said third means for receiving said fluids during one part of the reciprocation of said fourth means and for injecting said fluids into the formation traversed by said wellbore during a remaining part of the reciprocation of said fourth means.

18. The injection apparatus of claim 17, wherein said third means comprises:

restraining means for preventing said third means from rotating in the circumferential direction during its reciprocation in the longitudinal direction.

19. An injection apparatus adapted to be connected to a pipe on one end, adapted to be connected to a valve on the other end, and adapted to be disposed in a wellbore for injecting fluids into a formation traversed by said wellbore, comprising:

first means responsive to a longitudinal movement of said pipe for closing said valve; and second means responsive to a rotation movement of said pipe for injecting said fluids into the formation traversed by said wellbore when said valve is closed by said first means, said second means including, rotating means responsive to the rotational movement of said pipe for rotating in a circumferential direction, said rotating means including a plurality of rollers, said plurality of rollers being adapted to rotate in response to the rotation of said rotating means, reciprocating means connected to the rotating means for reciprocating in a longitudinal direction in response to the circumferential rotation of said plurality of rollers, said reciprocating means including a plurality of slots for receiving, respectively, said plurality of rollers, the rotation of said plurality of rollers when received in the respective plurality of slots reciprocating said reciprocating means, and valve means connected tot he reciprocating means for reciprocating int he longitudinal direction during the reciprocation of said reciprocating means, said valve means receiving said fluids during one part of the reciprocation of said valve means and injecting said fluids into the formation traversed by the wellbore during a remaining part of the reciprocation of said valve means.

20. Apparatus connected to a pipe and adapted to be disposed in a wellbore for delivering fluids from one location to another location, comprising:

a first valve having a full bore opening and an inlet flow channel disposed around said full bore opening;

first means connected between said first valve and and said pipe and responsive to a longitudinal movement of said pipe for closing said full bore opening of said first valve and opening said inlet flow channel of said first valve; and pump means responsive to the closing of said full bore opening and the opening of said inlet flow channel of said first valve by said first means and further responsive to a rotation movement of said pipe for pumping said fluids from said one location through said inlet flow channel of said first valve to said another location thereby delivering said fluids from said one location to said another location.

21. The apparatus of claim 20, wherein said pump means comprises:

rotating means responsive to the rotational movement of said pipe for rotating in a circumferential direction, said rotating means including a plurality of rollers, said plurality of rollers being adapted to rotate in response to the rotation of said rotating means, reciprocating means connected to the rotating means for reciprocating on a longitudinal direction in response tot he rotation of said plurality of rollers, said reciprocating means including a plurality of slots for receiving, respectively, said plurality of rollers, the rotation of said plurality of rollers when received in the respective plurality of slots reciprocating said reciprocating means, said a second valve reciprocating int he longitudinal direction during the reciprocation of said reciprocating means, the inlet flow channel of said first valve receiving said fluids from said one location during one part of the reciprocation of said second valve and delivering said fluids to said another location during a remaining part of the reciprocation of said second valve.

22. The apparatus of claim 20, wherein said one location is a wellbore and said another location is a surface of said wellbore, the pump means pumping said fluids from said wellbore through said inlet flow channel and to said surface of said wellbore.

23. The apparatus of claim 20, wherein said one location is a surface of said wellbore and said another location is a formation traversed by said wellbore, the pump means pumping said fluids from said surface of said wellbore through said inlet flow channel and into said formation traversed by said wellbore.

24. The apparatus of claim 21, wherein said one location is a wellbore and said another location is a surface of said wellbore, the pump means pumping said fluids from said wellbore through said inlet flow channel and to said surface of said wellbore.

25. The apparatus of claim 21, wherein said one location is a surface of said wellbore and said another location is a formation traversed by said wellbore, the pump means pumping said fluids from said surface of said wellbore through said inlet flow channel and into said formation traversed by said wellbore.

26. In an apparatus including a pipe and a valve adapted to be disposed in a wellbore for delivering fluids from one location to another location, said valve including a full bore opening and an inlet flow channel disposed around said full bore opening, a method practiced by said apparatus for delivering said fluids from said one location to said another location, comprising the steps of:

moving said pipe in a longitudinal direction when said apparatus is disposed in said wellbore thereby closing said full bore opening and opening said inlet flow channel of said valve;

following the moving step, rotating said pipe in a circumferential direction;

during the rotating step, flowing said fluids through said inlet flow channel of said valve, said fluids being delivered from said one location to said another location during the flowing step.

27. The method of claim 26, wherein said one location is the wellbore, said another location is a surface of said wellbore, said flowing step including the steps of:

flowing said fluids from said wellbore through said inlet flow channel of said valve and pumping the fluids to said surface of said wellbore.

28. The method of claim 26, wherein said one location is a surface of the wellbore, said another location is a formation traversed by said wellbore, said flowing step including the steps of:

flowing said fluids from said surface of said wellbore through said inlet flow channel of said valve and injecting said fluids into said formation traversed by said wellbore.

* * * * *